US010829331B2

(12) United States Patent
Clement

(10) Patent No.: US 10,829,331 B2
(45) Date of Patent: Nov. 10, 2020

(54) METHOD FOR PROTECTING A CONVERTING UNIT FOR CONVERTING A WEB SUBSTRATE, FEEDING STATION AND PACKAGING PRODUCTION MACHINE

(71) Applicant: BOBST MEX SA, Mex (CH)

(72) Inventor: Philippe Clement, Panthalaz (CH)

(73) Assignee: BOBST MEX SA

( * ) Notice: Subject to any disclaimer, the term of this patent is extended or adjusted under 35 U.S.C. 154(b) by 0 days.

(21) Appl. No.: 15/293,406

(22) Filed: Oct. 14, 2016

(65) Prior Publication Data

US 2017/0057771 A1 Mar. 2, 2017

Related U.S. Application Data

(62) Division of application No. 13/809,935, filed as application No. PCT/EP2011/003106 on Jun. 24, 2011.

(30) Foreign Application Priority Data

Jul. 14, 2010 (EP) ..... 10007237

(51) Int. Cl.
*B65H 26/02* (2006.01)

(52) U.S. Cl.
CPC ..... *B65H 26/02* (2013.01); *B65H 26/025* (2013.01); *B65H 2301/4491* (2013.01)

(58) Field of Classification Search
CPC ..... B65H 26/02; B65H 2301/4491; B65H 26/025; B65H 29/58
See application file for complete search history.

(56) References Cited

U.S. PATENT DOCUMENTS

| | | | | |
|---|---|---|---|---|
| 3,822,877 | A | 7/1974 | Littleton | 270/56 |
| 3,831,929 | A | 8/1974 | Hellmer | 271/303 |
| 4,244,504 | A * | 1/1981 | Grob | B65H 20/24 226/114 |
| 4,322,802 | A * | 3/1982 | Lewis, Jr. | B41F 33/00 26/98 |
| 4,852,785 | A | 8/1989 | Bettendorf et al. | 226/42 |
| 4,863,086 | A | 9/1989 | Armelin | 226/114 |

(Continued)

FOREIGN PATENT DOCUMENTS

| | | |
|---|---|---|
| CH | 602 462 | 7/1978 |
| CH | 618 660 | 8/1980 |

(Continued)

OTHER PUBLICATIONS

International Search Report dated Oct. 4, 2011 issued in corresponding International Patent Application No. PCT/EP2011/003106.

*Primary Examiner* — Jonathan G Riley
(74) *Attorney, Agent, or Firm* — Ostrolenk Faber LLP

(57) ABSTRACT

A method for protecting a unit for converting a web substrate to limit a jam of the substrate inside the unit, the unit converting the substrate when the unit is stopped, in a packaging production machine: the steps of: detecting at the outlet of the unit that the converted web does not come out; stopping a motor of an infeed arrangement to prevent the substrate from entering the unit; stopping a motor of a feathering drive; and simultaneously stopping the machine, and guiding the substrate to an accumulation storage.

13 Claims, 3 Drawing Sheets

(56) References Cited

U.S. PATENT DOCUMENTS

| | | | | |
|---|---|---|---|---|
| 5,058,879 | A | 10/1991 | Dunaway | 271/259 |
| 5,163,371 | A | 11/1992 | Kotterer et al. | 101/484 |
| 5,316,289 | A | 5/1994 | Matsuo | 271/258.03 |
| 5,595,335 | A | 1/1997 | Borel | 226/42 |
| 5,685,472 | A | 11/1997 | Borel | 226/114 |
| 5,884,542 | A * | 3/1999 | Gentile | B21C 51/00 192/127 |
| 6,065,401 | A * | 5/2000 | Marmin | B65H 26/025 101/228 |
| 2004/0255560 | A1 | 12/2004 | Noble | 53/469 |
| 2005/0010323 | A1 | 1/2005 | Cocciadiferro et al. | 700/174 |
| 2005/0029391 | A1 | 2/2005 | Cocciadiferro et al. | 242/559.1 |
| 2007/0245917 | A1* | 10/2007 | Suzuki | B65H 26/025 101/424.1 |
| 2011/0239598 | A1* | 10/2011 | Borel | B65H 20/24 53/545 |
| 2013/0068874 | A1* | 3/2013 | Schwamberger | B65H 19/283 242/526.1 |

FOREIGN PATENT DOCUMENTS

| | | |
|---|---|---|
| CH | 633 230 A5 | 11/1982 |
| DE | 197 22 243 | 12/1998 |
| DE | 101 29 889 | 1/2002 |
| DE | 103 38 973 | 4/2004 |
| EP | 0 742 170 | 11/1996 |
| WO | WO 2010/063353 | 6/2010 |
| WO | WO 2016/066325 | 6/2010 |

* cited by examiner

METHOD FOR PROTECTING A CONVERTING UNIT FOR CONVERTING A WEB SUBSTRATE, FEEDING STATION AND PACKAGING PRODUCTION MACHINE

CROSS-REFERENCE TO RELATED APPLICATIONS

The present application is a divisional under 37 C.F.R. § 1.53(b) of prior U.S. patent application Ser. No. 13/809,935, filed Jan. 14, 2013, which in turn is a U.S.C. § 371 National Phase conversion of PCT/EP2011/003106, filed Jun. 24, 2011, which claims priority of European Patent Application No. 10007237.0, filed Jul. 14, 2010. The PCT International Application was published in the French language. The contents of each of these applications are incorporated in full by reference herein.

BACKGROUND OF THE INVENTION

The present invention relates to a method for protecting a unit for converting a web substrate. The invention also relates to a station for feeding a converting unit with a wen substrate. The invention also relates to a packaging production machine comprising a feeding station and a converting unit.

A packaging production machine is designed for the manufacture of boxes that will be suitable for forming packages, by folding and gluing. In this machine, the production begins with an initial web substrate, that is to say a virgin web, for example of cardboard, which is unwound in a continuous manner, printed by one or more printing units, optionally embossed, and then cut in a diecutting platen press.

The substrate converted in the form of blanks or of boxes obtained by cutting are then shingled, before being stacked in rows in order to form stacks in a delivery and palletizing station for the purpose of storing them or of conveying them away from the machine.

A diecutting platen press or also a printing platen is a converting unit that requires a momentary stop in the progression of the web substrate during the conversion. Because of the continuous feeding upstream, there occurs an accumulation of the substrate in the form of an upstream loop.

A feeding station is used first of all to place the printing in longitudinal and lateral register with the cutting. The other function of the feeding station is to cyclically create and to control at all times this loop which lengthens during the stoppage due to the work of the press, and which shortens as soon as the feeding of the press resumes for the purpose of the subsequent conversion. The feeding station converts the continuous progression of the substrate into an intermittent progression, on each working cycle of the converting unit, while keeping the substrate in tension at the loop control.

STATE OF THE ART

The phases of accelerating, of decelerating the substrate in the feeding station, and the conversion being carried out flat in the unit are very sensitive to the quality and to the type of the web substrate. As an example, the substrate that is at the beginning of a reel does not have the same physical qualities as the substrate at the end of a reel, and this is so for one and the same reel of substrate unwinding at the inlet of the machine. Despite the presence of a web decurler, jams occur in the converting unit.

Documents CH-602.462 and CH-618.660 describe a feeding station for a diecutting platen press, comprising a pulling member and a feathering drive leading the substrate around the circumference of an off-center roller mounted between two rotary plates.

These existing constructions come out of adjustment and also wear quite rapidly, which leads to jams of the substrate in the feeding station and in the converting unit formed by the press.

Also known according to documents EP-742.170 and WO-2010/063.353 are a device and a station for feeding a converting unit with a substrate, the unit working on the substrate when stopped. This device comprises a first roller, called a drive roller, also known as a draw roller or feathering drive, around which there oscillates cyclically, in the upstream direction and then in the downstream direction, a second roller, called a satellite roller. An infeed arrangement, designed to feed a converting unit, is mounted downstream of the feathering drive. The infeed arrangement comprises a bottom roller driven in rotation.

In the event of jamming of the substrate inside the converting unit, the whole machine, with the converting unit and the feeding station, is automatically stopped with the aid of means for detecting the jam that are placed downstream of the unit. However, because of the inertia of the drive, the web substrate will continue to enter the unit until the progression of the web is completely stopped. The substrate will form a jam.

In order to remove the web substrate that has accumulated inside the unit, for example inside the press, the operator must intervene in a very narrow zone between upper and lower beams, as well as in the tablet of platen infeed. The material that has agglomerated and compacted forms plugs that are extremely solid. The machine operator must then extract the material and clean the unit, most frequently by hand. During this long period of stoppage, the machine is no longer in production.

Because of the very high pressure exerted by the substrate entering the unit, the result of this is a twisting or even a destruction of the converting tools, in this case the cutting tools and creasing counterparts, and of certain mechanical parts, and possibly electrical parts, of the unit. All of these tools must be replaced and again adjusted for the accuracy of cutting. This operation to repair the unit takes time and is extremely costly.

SUMMARY OF THE INVENTION

A main object of the present invention is to develop a method for protecting a unit for converting a web substrate. A second object is to prevent damaging the converting tools that are present in the converting unit in the event of a jam. A third object is to conserve the longitudinal and lateral register of the substrate between the feeding and the converting, while stopping the converting unit, the feeding station and the packaging production machine. A fourth object is to produce a packaging production machine allowing a converting of a substrate, comprising a feeding station and a unit for converting the substrate, and protection means. Yet another object is that of providing modifications for protecting a feeding station of a converting unit with a web substrate.

According to the present invention, a method for protecting a unit for converting a web substrate is designed to limit a jam of the web substrate inside the unit for converting the web substrate, this unit for converting the web substrate converting the web substrate when stopped, in a packaging production machine. The method comprises the successive steps consisting in:

- detecting, at the outlet of the unit for converting the web substrate, that the converted substrate does not come out;
- stopping a motor of an infeed arrangement so as to prevent the web substrate entering the unit for converting the web substrate;
- stopping a motor of a feathering drive in the feeding station; and in simultaneously stopping the packaging production machine.

In other words, the first step is used to detect whether or not a converted substrate comes out of the converting unit. If the converted substrate does not come out, while the unit, the feeding station and the machine are in operation, a signal corresponding to a jam malfunction is emitted. The jam of the substrate is thus immediately detected and then dealt with.

With the second step consisting in stopping a motor of an infeed arrangement, the movement of the substrate toward and inside the unit is halted instantaneously. The jam inside the unit is immediately stopped and does not get worse.

With the third step consisting in stopping a motor of a feathering drive, separate from the second step, the progression of the substrate is stopped gradually. This makes it possible to stop the whole machine at the same time. The arrival of the substrate at the feeding station and at the converting unit is stopped.

With this gradual stoppage, the register is kept in an acceptable range. In contrast with the invention, too rapid a stop or an emergency stop are found to be excessively sudden stops, which consequently cause a risk of disruptions, or even a risk of breakage of the web substrate. With a slower stop, the adjustments and the parameters used to control the machine are retained.

By virtue of the invention, the jam in the unit and in the station is minimized. The operator therefore rapidly proceeds with the subsequent restarting of the whole machine as soon as he has removed a small quantity of web substrate and cleaned the unit and the station.

In the whole of the description, the longitudinal direction is defined with reference to the median axis of the packaging production machine, of the feeding station and of the converting unit. This direction is determined by that of the drive of the web substrate. The transverse and lateral direction is defined as being the direction perpendicular to the direction of drive of the substrate. The upstream and downstream directions are defined by making reference to the direction of progression of the substrate, in the longitudinal direction, respectively before and after the feeding station and the converting unit.

In another aspect of the invention, a station able to feed a converting unit with a web substrate, the converting unit converting the web substrate when stopped, comprises a feathering drive, a loop control and an infeed arrangement. The feeding station is characterized in that it comprises accumulation means for the web substrate.

According to yet another aspect of the invention, a packaging production machine comprises

- a unit for converting a web substrate, able to convert the web substrate when stopped, and
- a station for feeding the unit with the web substrate, having a feathering drive and an infeed arrangement.

The packaging production machine is characterized in that it comprises:

- means for detecting a jam of the web substrate inside the converting unit and sending a jam signal corresponding to a jam of the web substrate inside the converting unit, these means being positioned at the outlet of the unit, and
- means for processing the jam signal, able to generate stop signals, respectively intended for the infeed arrangement, for the feathering drive, and for the packaging production machine.

BRIEF DESCRIPTION OF THE DRAWINGS

The invention will be clearly understood and its various advantages and features will better emerge from the following description of the nonlimiting exemplary embodiment, with reference to the appended schematic drawing in which.

DETAILED DESCRIPTION OF PREFERRED EMBODIMENTS

Figure 1:
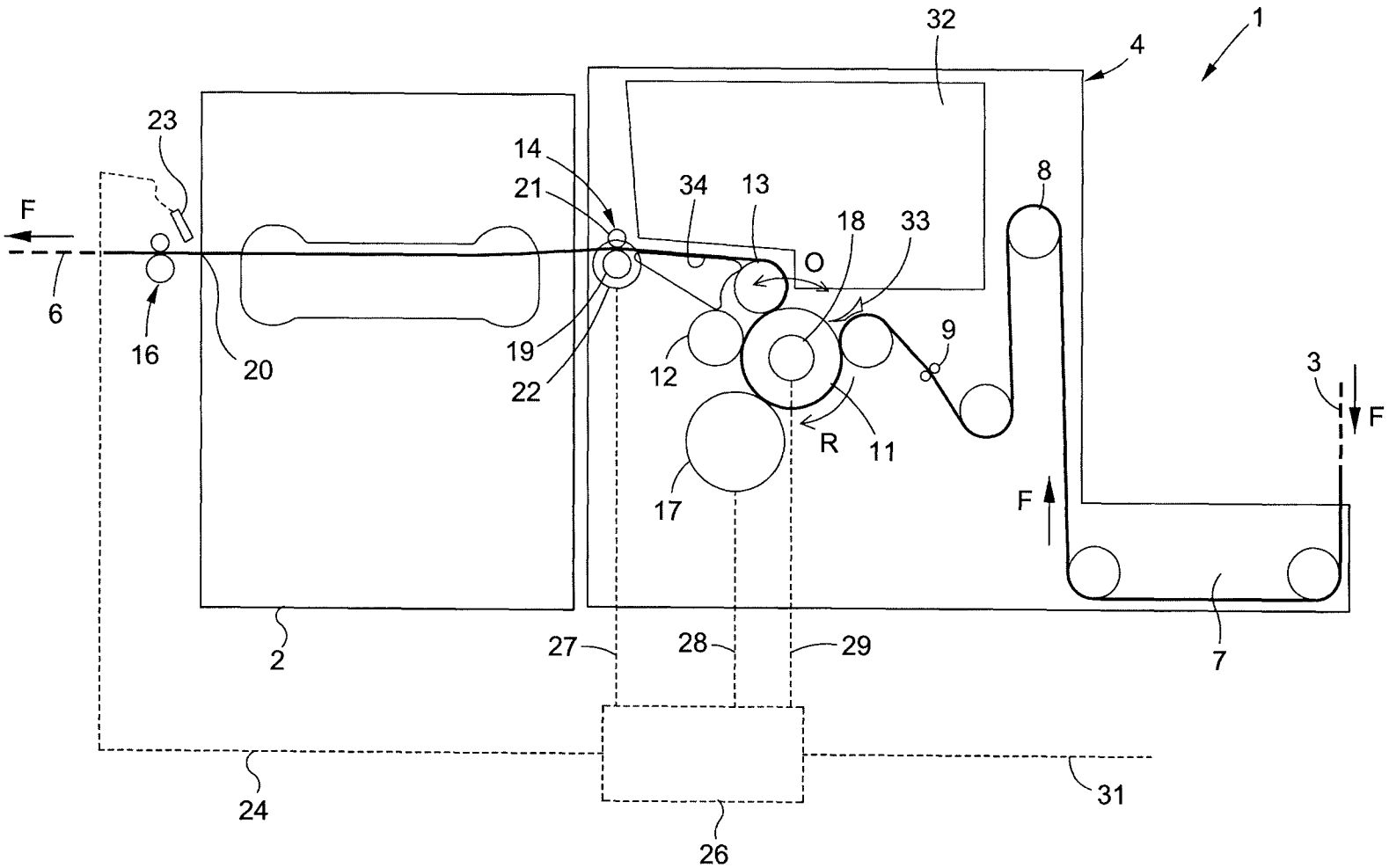
FIG. 1 represents a synoptic side view of a portion of a packaging production machine, comprising a feeding station and a converting unit, with a satellite roller shown in an extreme downstream position.

As illustrated in the FIGURE, a packaging production machine 1 comprises a converting unit which, in this case, is a diecutting platen press 2. The press 2 converts a material or a web substrate 3. In this example, the web 3 is flat cardboard and this cardboard is cut in the press 2. A feeding station 4 is positioned upstream of the press 2. The station 4 receives the web 3 upstream, arriving at a constant speed.

Upstream of the station 4, the machine 1 has, as an example, printing units, means for monitoring the quality and the register of the printing, as well as means for embossing or any other means (not shown) for modifying the surface of the web 3.

The station 4 delivers this same web 3 downstream to the press 2 at an intermittent speed. The press 2 cuts the web 3 when stopped and delivers it in the form of blanks 6. The substrate, that is to say the web 3, changes from an unconverted substrate state to a converted substrate state, that is to say the blanks 6. The blanks 6 come out downstream of the press 2. The direction of travel or of progression (arrow F) of the web 3 and of the blanks 6 in the longitudinal direction indicates the upstream direction and the downstream direction.

In order to ensure an optimum operation of the press 2, the station 4 may comprise, in order from upstream to downstream:

- a lateral web guiding 7, used for correcting the lateral register of the web 3 if necessary;
- an dancer roller 8, designed to establish a constant tension of the web 3;
- a web straightener 9 also known as a "decurler", designed to straightened the curves of the cardboard;
- a feathering drive 11;
- a pressing roller 12, positioned against the feathering drive 11, so as to hold the web 3 against the feathering drive 11; and
- a loop control 13.

A first infeed arrangement 14, for guiding, driving and taking the web 3 into the press 2, is positioned downstream of the feathering drive 11 and of the loop control 13 and upstream of the press 2. The infeed arrangement 14 is installed by being fastened in the feeding station 4. A second outlet arrangement 16 for guiding, driving and bringing the cut blanks 6 out of the press 2, is positioned downstream of the press 2.

The feathering drive is formed by a main drive roller 11, rotating on a main shaft (arrow R). The main shaft and therefore the main roller 11 are installed substantially on the horizontal and perpendicularly to the direction of progression of the web 3. The main roller 11 therefore continuously drives the web 3 from upstream to downstream. A main electric drive motor 17 rotates the main roller 11.

The loop control comprises a satellite roller 13 placed side by side to and parallel with the main roller 11. The web 3 is engaged between the main roller 11 and this satellite roller 13 and it is held there while being able to be driven. The web 3 forms a path which covers approximately three-quarters of a circumference of the main roller 11 and half a circumference of the satellite roller 13.

Figure 2:
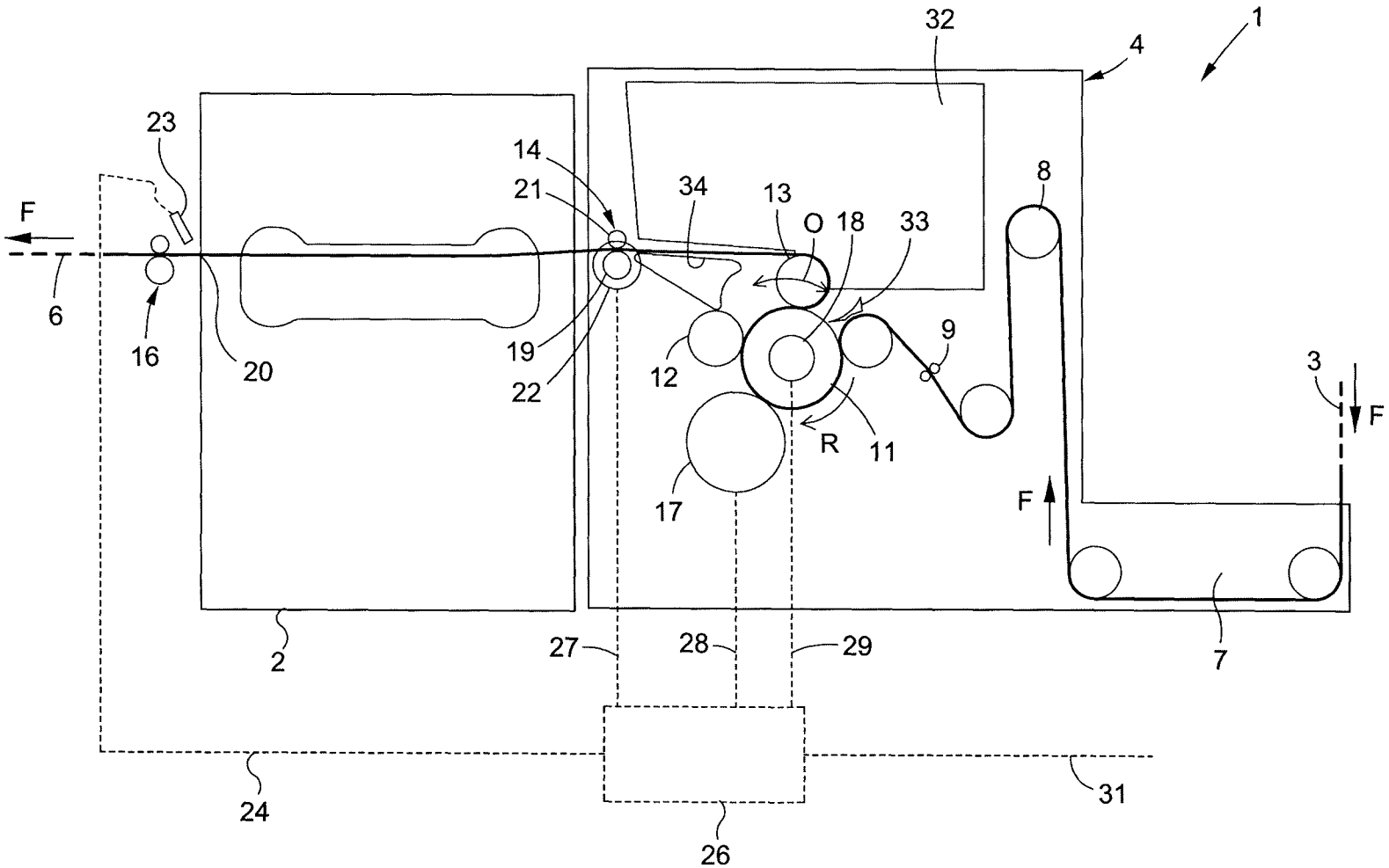
FIG. 2 represents the synoptic side view of the portion of the packaging production machine of FIG. 1, with the satellite roller shown in an upstream position.

The satellite roller 13 is able to oscillate (arrow O) around the main drive roller 11, from upstream to downstream and vice versa from downstream to upstream. In FIG. 1, the satellite roller 13 is shown in the extreme downstream position. In that position, the satellite roller 13 of the loop control blocks access past the barrier 34 through the opening 35 and into the storage 32. A secondary electric drive motor 18 causes the satellite roller 13 to oscillate. In FIG. 2, the satellite roller 13 is shown in an upstream position.

The frequency of the oscillations O of the satellite roller 13 generates variations in speed of the web 3. The web 3 changes cyclically from a constant speed to a zero speed, and vice versa from a zero speed to a constant speed. These speed variations and hence the frequency of the oscillations O are chosen as a function of the cutting strike speed of the press 2 situated downstream.

The infeed arrangement 14 comprises a bottom roller and a series of top pressure rollers 21. The web 3 is engaged, held and driven into the press 2 between the roller 19 and the pressure rollers 21. The roller 19 is rotatably driven by an electric motor 22. The outlet arrangement 16 for the blanks 6 has substantially the same mechanical structure as the infeed arrangement 14 for the web 3.

The infeed arrangement 14 is also known as the MIR or modulated infeed roller. The outlet arrangement 16 is also known as the MOR or modulated outlet roller. The infeed arrangement 14 and the outlet arrangement 16 are for example substantially similar to that described in the document WO-2010/066.325.

According to the invention, means for detecting a jam, advantageously in the form of a detection cell 23, are mounted in the machine 1, by being positioned downstream and directly at the outlet of the press 2. This cell 23 monitors the blanks 6 coming out and counts the blanks 6. The cell 23 identifies, on the surface, the presence or the absence of blanks 6 coming out of the press 2. The cell 23 generates and sends a count signal which is transformed into a jam signal 24 if no blanks 6 come out.

Means for processing the jam signal 24, for example in the form of a signal processing system 26 for controlling the protection of the press 2, are provided in the machine 1 and in the feeding station 4. The system 26 is able to generate stop signals 27, 28, 29 and 31.

The first stop signal 27 is intended for the infeed arrangement 14 and comprises an instruction for an instantaneous stop of the motor 22 of the roller 19. The second stop signal 28 is intended for the feathering drive 11 and comprises an instruction for the gradual stopping of the motor 17 of the feathering drive 11. The third stop signal 29 is intended for the loop control 13 and comprises an instruction for an instantaneous stop of the motor 18 of the satellite roller 13. The third stop signal 29 also comprises an instruction to park the satellite roller 13 in an out-of-the-way position. The fourth stop signal 31 is intended for the machine 1 and comprises an instruction to stop all the units comprised in the machine 1, and that are situated upstream and downstream of the press 2 and of its feeding station 4.

Figure 3:
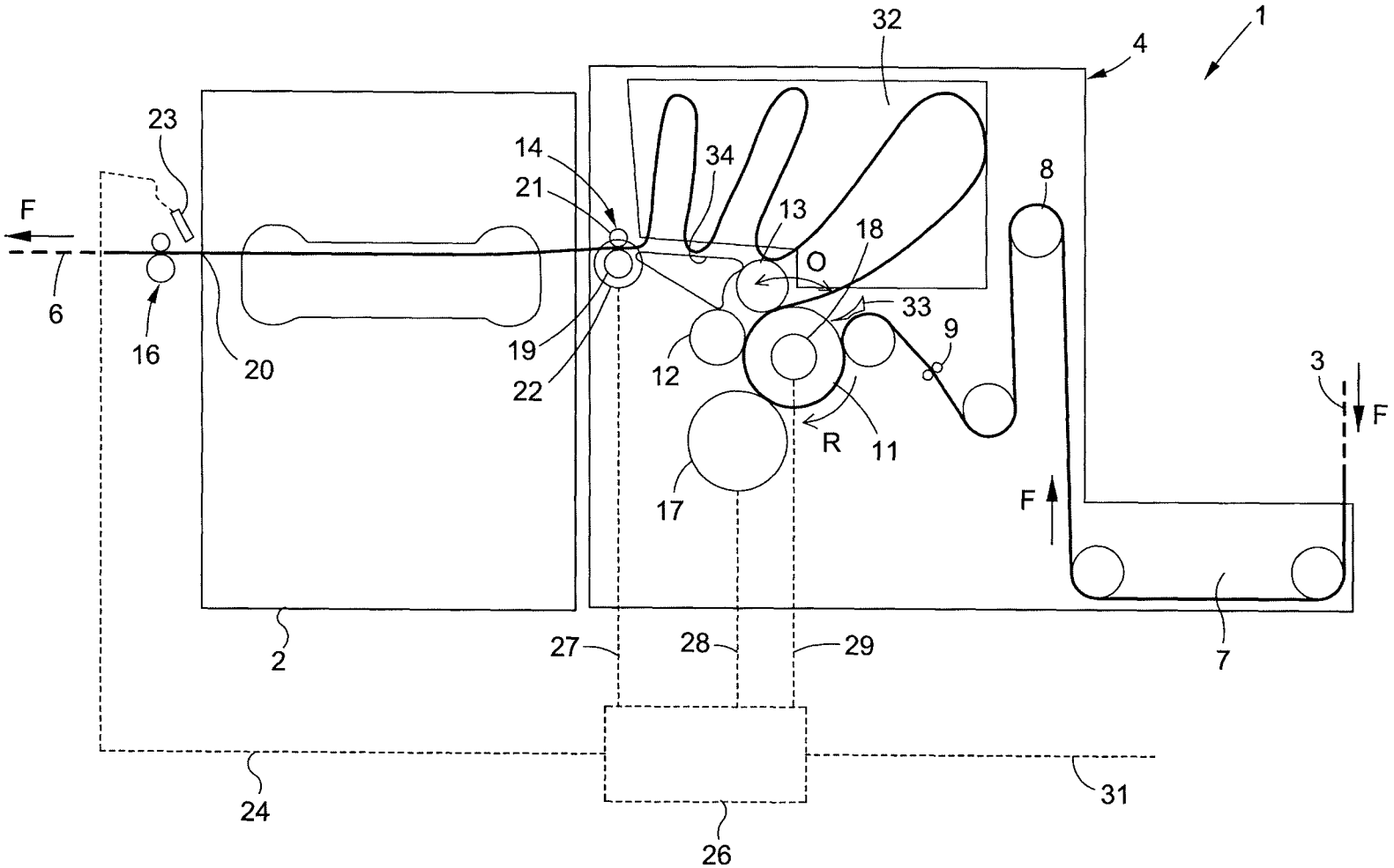
FIG. 3 represents the synoptic side view of a portion of the packaging production machine of FIG. 1, with a jam of web.

The feeding station 4 preferably comprises means of accumulation, in the form of a volume or of a storage 32 for accommodating the remainder of the web 3, during the transitional phase between the stopping of the infeed arrangement 14 and the stopping of the feathering drive 11. The web 3 is inserted and is placed in this storage 32 until the feathering drive 11 has completely stopped (see FIG. 3). The storage 32 is arranged in the top portion of the station 4. This storage 32 has an opening at 35 oriented downward in the direction of the loop control 13 and of the feathering drive 11. In FIG. 1, the satellite roller 13 blocks the opening 35 by contacting the barrier 34. In FIG. 2, the satellite roller oscillates to the upstream direction, opening the opening 35 into the storage 32, which permits accumulation of the web substrate, as in FIG. 3.

Mechanical protection means are provided at the feeding station 4. These mechanical protection means take the form of guidance means 33 and of barrier means 34.

The means 33 for guiding the web 3 toward the storage 32 are advantageously provided and oriented upward so that the remainder of the web 3 slides in the direction of the opening of the storage 32 and is then introduced into this storage 32. These means 33 take the form of protection and guidance metal sheets.

The barrier means 34 for the web 3 are advantageously provided and oriented so that the remainder of the web 3 does not feed into other portions of the station 4. These barrier means 34 prevents the remainder of the web 3 from damaging the parts forming the feeding station 4, and more particularly the loop control 13, the pressing roller 12, and the feathering drive 11.

The method for protecting the press 2 against the jamming of the web 3 according to the invention comprises several successive steps. During normal operation, the loop is in a first state. A first step, corresponding to the jam signal 24, consists in detecting that no blanks 6 come out of the press 2, with the aid of the cell 23, associated with the system for processing the signal 26.

A second step, corresponding to the first stop signal 27, consists in instantaneously stopping the motor 22 of the infeed arrangement 14, so as to prevent any of the web 3 entering the press 2. Then, the inside of the press 2 contains only the blanks 6 that have caused the jam. This jam is much easier to clear, because the press 2 contains only cardboard that remains flat. With the stopping of the motor 22 of the infeed arrangement 14, the press 2 is protected against any more web 3 arriving.

A third step, corresponding respectively to the second and to the fourth stop signals 28 and 31, consists in gradually stopping and slowing the motor 17 of the feathering drive 11 and in simultaneously stopping the whole machine 1.

Advantageously the method comprises an additional step consisting in calculating a waiting time between the step consisting in stopping the motor 22 of the infeed arrangement 14 and the step consisting in stopping the motor of the feathering drive 11. This wait and hence the progression of the web 3 makes it possible to gently stop the progression of the web 3 without breaking this web 3. This wait also makes it possible to preserve the mechanical parts of the press 2 and of the station 4.

An additional step, corresponding to the third stop signal 29, occurs at the same time as the step consisting in stopping the motor 22 of the infeed arrangement 14 and before the step consisting in stopping the motor 17 of the feathering drive 11. This step, in which the loop control is in a second state, consists in stopping the motor 18 of the loop control 13. This step also consists in immediately placing the loop control with its satellite roller 13 in a parking position.

In this position, the satellite roller 13 is on the left (see the FIGURE), in the downstream position, against the barrier means 34. This position protects on the one hand this same loop control 13 against the web 3 that is arriving, when the motor 17 of the feathering drive 11 is still running. On the other hand, this position will help access to the web 3 at the bottom opening of the storage 32.

The method comprises an additional step, occurring after the step consisting in stopping the motor 22 of the infeed arrangement 14 and before the step consisting in stopping the motor 17 of the feathering drive 11. This step consists in guiding the web 3 toward the storage 32, when the motor 17 of the feathering drive 11 is still running, with the appropriate protection, guidance and barrier means 33 and 34.

By virtue of the invention, when the operator has extracted the small jam of web 3 or of blanks 6 from the press 2 and when the operator has emptied the storage 32 by taking out the web 3, the restart of the machine 1 and of the press 2 will be very rapid.

The present invention is not limited to the embodiments described and illustrated. Many modifications may be made nevertheless without departing from the context defined by the scope of the set of claims.

What is claimed is:

1. A feeding station configured to feed a web substrate to a substrate processing machine, the feeding station comprising:

a feathering drive configured for receiving the web substrate and for feeding the web substrate toward the substrate processing machine;

a loop control engaging the web substrate and configured to be operated in a first state, the loop control configured to move in the first state to generate variations in speed of the web substrate as the web substrate is passing the feathering drive;

an infeed arrangement positioned downstream of the feathering drive in a direction of web substrate movement, and configured for feeding the web substrate toward an exit of the feeding station;

a pressing roll at the feathering drive positioned and configured for holding the web substrate to the feathering drive;

an accumulation storage configured to store the web substrate, the accumulation storage comprising an entrance located near the feathering drive for entrance of the web substrate into the accumulation storage from the feathering drive when the web substrate is being fed to the infeed arrangement past the feathering drive when the loop control is in a second state; and a signal processor configured to transmit a stop signal from a detection cell and cause the loop control to enter the second state, the loop control in the second state configured to move to a parking position against a mechanical barrier.

2. The feeding station according to claim 1, wherein the entrance of the accumulation storage comprises an opening oriented in the direction of the loop control.

3. The feeding station according to claim 1, wherein the feeding station comprises from upstream to downstream: a lateral web guide configured to feed the web substrate toward the feathering drive; the feathering drive, the loop control and the infeed arrangement.

4. The feeding station according to claim 3, comprising, upstream of the feathering drive, a dance roller and a web decurler.

5. The feeding station according to claim 1, wherein the loop control comprises a satellite roller.

6. The feeding station according to claim 1, wherein the accumulation storage is positioned above the loop control.

7. The feeding station according to claim 1, wherein the feathering drive comprises a feathering roll and a holding device for holding the web substrate to the feathering roll so that the web substrate passes around the feathering roll and does not enter the entrance into the accumulation storage as the web substrate moves from the web guide to the exit to the converting unit from the feeding station, in the first state.

8. The feeding station according to claim 7, further comprising the web substrate loop control at the feathering roll is movable for controlling the movement of the web substrate through the feathering device.

9. The feeding station according to claim 8, wherein the loop control comprises a loop control roll in contact with the web substrate on the feathering roll as the loop control roll oscillates between positions of blocking and opening the entrance into the accumulation storage.

10. The feeding station according to claim 1, wherein the loop control comprises a satellite roll and the satellite roll contacts and oscillates around the feathering drive controlling the speed of the web substrate past the feathering drive.

11. The feeding station according to claim 1, wherein the loop control holds the web substrate to the feathering drive as the loop control oscillates.

12. The feeding station of claim 1, wherein the mechanical is barrier positioned and configured to prevent the web substrate entering the infeed arrangement when the loop control is in the second state.

13. The feeding station of claim 1, wherein in the first state the loop control is moved to oscillate to generate the variations in speed of the web substrate.

* * * * *